US005092411A

United States Patent [19]

Hausherr et al.

[11] Patent Number: 5,092,411

[45] Date of Patent: Mar. 3, 1992

[54] DRILLING APPARATUS

[75] Inventors: Heinrich-Rudolf Hausherr, Witten; Friedhelm Eckey, Sprockhövel, both of Fed. Rep. of Germany

[73] Assignee: Rudolf Hausherr & Sohne GmbH & Co. KG, Sprockhovel, Fed. Rep. of Germany

[21] Appl. No.: 445,594

[22] PCT Filed: Mar. 11, 1989

[86] PCT No.: PCT/EP89/00256

§ 371 Date: Nov. 8, 1989

§ 102(e) Date: Nov. 8, 1989

[87] PCT Pub. No.: WO89/08769

PCT Pub. Date: Sep. 21, 1989

[30] Foreign Application Priority Data

Mar. 15, 1988 [DE] Fed. Rep. of Germany ..... 3808525
Dec. 14, 1988 [DE] Fed. Rep. of Germany ..... 3842081

[51] Int. Cl.[5] ..... E21B 3/02

[52] U.S. Cl. ..... 175/162; 173/105; 173/114; 175/189; 175/203

[58] Field of Search ..... 175/122, 135, 162, 189, 175/203; 173/81, 83, 105, 106, 107, 108, 114

[56] References Cited

U.S. PATENT DOCUMENTS

| | | | |
|---|---|---|---|
| 2,151,206 | 3/1939 | Hawthorn . | |
| 2,766,011 | 10/1956 | Winder | 175/189 X |
| 3,371,726 | 3/1968 | Bouyoucos | 173/134 |
| 3,565,190 | 2/1971 | Ishii . | |
| 3,786,874 | 1/1974 | Jodet et al. | 173/114 X |
| 3,844,345 | 10/1974 | Evans et al. . | |
| 4,860,837 | 8/1989 | Robert | 175/162 X |

FOREIGN PATENT DOCUMENTS

| | | |
|---|---|---|
| 0204128 | 12/1986 | European Pat. Off. . |
| 0233038 | 8/1987 | European Pat. Off. . |
| 2734111 | 3/1978 | Fed. Rep. of Germany . |
| 2749864 | 6/1979 | Fed. Rep. of Germany . |
| 3240263 | 5/1984 | Fed. Rep. of Germany . |
| 3331846 | 3/1985 | Fed. Rep. of Germany . |

*Primary Examiner*—William P. Neuder
*Attorney, Agent, or Firm*—Herbert Dubno

[57] ABSTRACT

A drilling apparatus, especially for drilling blast holes, includes a carriage, a drilling rod, a pressure-operated drive system movable along the carriage for transmitting a back and forth rotation to the drilling rod, a flushing head arranged on the carriage and movable either with or apart from the drilling rod, and a hydraulically operated in-hole hammer arranged on a front end of the drilling rod.

20 Claims, 3 Drawing Sheets

DRILLING APPARATUS

FIELD OF THE INVENTION

The present invention relates to a drilling apparatus, in particular a drilling apparatus used for drilling shot holes, with a carriage for advancing and withdrawing the drilling rod that comprises a plurality of sections, an advance system, a pressure-operated drive system for the drilling rod, a flushing head that is arranged on the carriage, which can be moved either with or apart from the drilling rods, and a hydraulically operated in-hole hammer that is arranged on the front end of the drilling rod.

THE RELATED ART

Drilling apparatuses of this kind have been known for a considerable time, and are used in underground mining, tunnel building, and in the stone and earth quarrying industry. The advantage of the in-hole hammer system is that its blows are made directly on its chisels, so that there are not energy losses in the drilling rods, compared to the embodiment in which the hammers are arranged behind the drilling rods. In the case of hammers that are powered by means of compressed air, the working air also serves to remove the drilling debris from the hole. This is not possible in the case of hydraulically powered hammers, so that for these, three lines have to be provided in the drilling rods, i.e., one for the hydraulic feed to the hammer, one for the hydraulic return from the hammer, and one for the compressed air that is used to blow the drilling debris out of the hole. This embodiment entails the disadvantage that when the drilling rod is changed, the hydraulic system has to be shut down and that when the bore rods are separated and (re)connected, one has to accept losses of hydraulic oil and it will be impossible to avoid pollution.

Proceeding from this prior art, it is the task of the present invention to create a drilling apparatus of the type described in the introduction hereto, while avoiding the disadvantages set out above, which permits simple and rapid changing of the drilling rods when a hydraulically operated in-hole hammer that is arranged at the front end of the drilling rods is used.

SUMMARY OF THE INVENTION

According to the present invention, this has been achieved in that the compressed air operated drive for the drilling rods transmits a back and forth oscillatory movement to the drilling rods. Unlike former and conventional rotary drives, the system used herein provides for a back and forth oscillatory movement. This makes it possible to accommodate the required hoses in the annular space between the drilling rods and the walls of the drilled hole, with the result that these do not have to be parted when the rods are changed.

In order to achieve optimal drill performance and protection for the hoses that are used, the rotational range of the drilling rod is preferably restricted to an angle of pivot between 180° and 360°.

It is advantageous that an oscillating motor with a gear system is used for the drive system.

The transfer of torque to the drilling rods is effected by an interlocking shape-fit preferably through profiling of the drilling rods, or by a force fit, preferably through a clamping system.

According to another feature of the present invention, the pressure-operated drive system is located on a slide that can be moved on the carriage of the drilling apparatus. The movement of the slide with the drive system can be effected by means of an advance chain, through the flushing head and/or by means of separate drives.

In order to preclude, for all practical purposes, wear on the hoses that are used, according to another feature of the invention it is proposed that the drilling rods have two longitudinal channels that are open to the outside, and which serve to accommodate the hoses used for the feed and return lines for the hydraulic oil for the in-hole hammer. The hydraulic hoses are located within the periphery of the drilling rods and do not project beyond these, so that to a very great extent these hoses are protected against wear. Flushing air is supplied through the hollow drilling rods.

The longitudinal channels in the drilling rods ar narrower in their outer areas than in their inner areas, so that after being pressed through the narrow areas, the hoses can once again expand when in the interior of the longitudinal channels, because of their inherent elasticity, and are thus secured within said channels.

According to another feature of the present invention the drilling rods have a channel, which is open to the outside, that is used to accommodate an air hose for the flushing air.

At least in its lower area, the flushing head also incorporates longitudinal channels to accommodate hydraulic hoses and/or the air hose.

At their ends, the drilling rods are fitted with matching shaped elements that ensure that the drilling rods can be connected and yet are unable to rotate independently of each other, and also as to provide an aligned connection of the longitudinal channels, thereby ensuring that there is not only a trouble-free transmission of torque during the back and forth rotary movement, but that also, during connection of the individual drilling rods with each other, their longitudinal channels are always aligned with each other and that, if this is not the case, such assembly is not possible.

It is advantageous that the shaped elements comprise studs that project from one end of the drilling rods and recesses in the other ends of the drilling rods, the shapes of these two elements being matched to each other.

The ends of drilling rods that have been connected to each other are coupled by means of spring loaded locking pins, so that they can be easily and rapidly disconnected from or connected to each other.

The drilling rods can be provided with flushing-air lines, one being located within the drilling rods and the other ends of which project freely, the spring-loaded locking pins being arranged in these; these locking pins pass through the compressed air lines transversely to their longitudinal direction and in their locked positions fit into drillings in the walls of the adjacent drilling rod.

On the carriage, in front of the connection area of two drilling rods that are to be connected to each other there is a hose threading and removal system, by means of which the hoses can be pressed into longitudinal channels of the newly installed drilling rod during a drilling rod change, or can be removed from said longitudinal channels when the drilling rods are withdrawn. When the drilling rod is being advanced, the hoses are then inserted into the longitudinal channels during this advance, or else are removed from the longitudinal channels when the drilling rods are being withdrawn.

The hose threading and removal system is installed on the slide of the drive system for the drilling rods and coupled, either directly or indirectly, with its driving elements, so that this system follows the rotary movement that is transmitted to the drilling rods. The hose threading and removal system has an insertion and a removal system for each hose. The insertion and removal elements comprise guide rollers and/or slide guides. The insertion and removal elements for each hose are so spaced that the associated hose can be passed around the removal element that is remote from the drilling rods and between the removal element and the insertion element that is associated with the drilling rods.

The insertion and removal elements can be so designed as to fold out of the area of the drilling rods.

The drilling apparatus itself is equipped with a pre-tensioned drum for the hydraulic hoses and, optionally, for the compressed air hose, so that these hoses are always kept at the required length automatically. The length of the hoses is such that in each case these are always sufficient for the depth of the bore holes that are to be produced.

BRIEF DESCRIPTION OF THE DRAWING

An embodiment of the present invention is described in greater detail below on the basis of the drawings appended hereto. These drawings are as follows:

FIG. 3: A view of a drilling rod with the drive for the drilling rods being in the uppermost position;

DETAILED DESCRIPTION

Since a drilling machine of this type is known per se, there is no need for a drawing or a detailed description thereof.

A drilling rod 1 incorporates two longitudinal channels 2 that are open to the outside. These longitudinal channels 2 in cross-section have a shorter circumferential are in their outer areas 3 then in their inner areas.

The hydraulic hoses 4, 5 are installed in the longitudinal channels 2; of these hoses, one serves as the supply hose and the other as the return hose for the hydraulic oil used by the in-hole hammer that is installed at the lower end of the drilling rod.

The drilling rod 1 itself is hollow, so that the flushing that is required can be conducted through the drilling rod.

The hoses 4, 5 are securely held in the longitudinal channels 2 because of the reduced arc or width of these in their outer areas, since these hoses are installed in the longitudinal channels 2 by being compressed.

The hoses that are protected in this manner can follow the back and forth pivoting movements of the drilling rod, for example, through an angle of rotation of between 180° and 360° without any problem and without being subjected to any wear.

Figure 1:
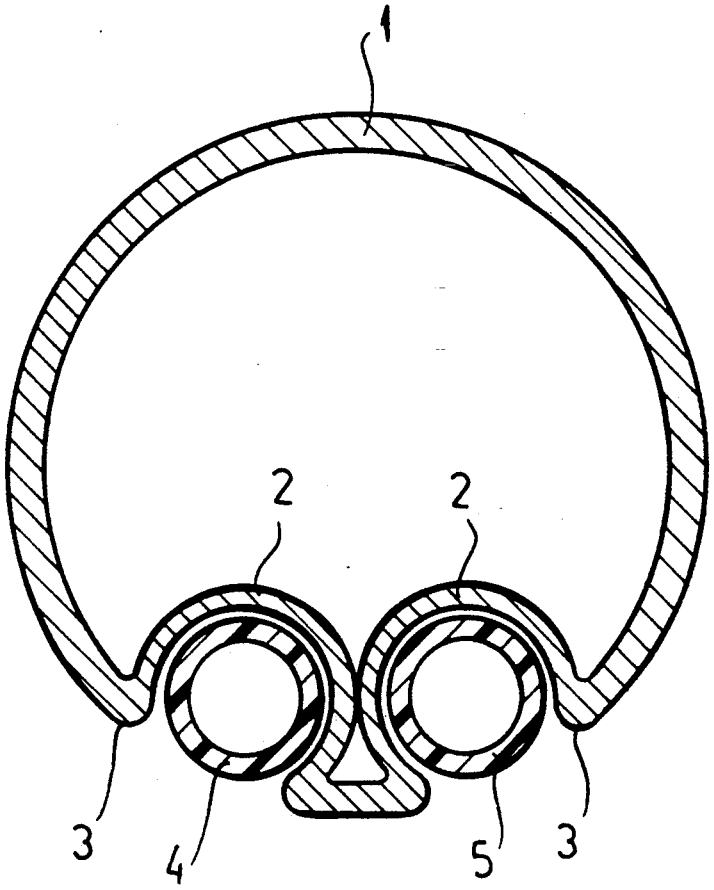
FIG. 1: A cross-sectional plan view of a first embodiment of a drilling rod.
Figure 2:
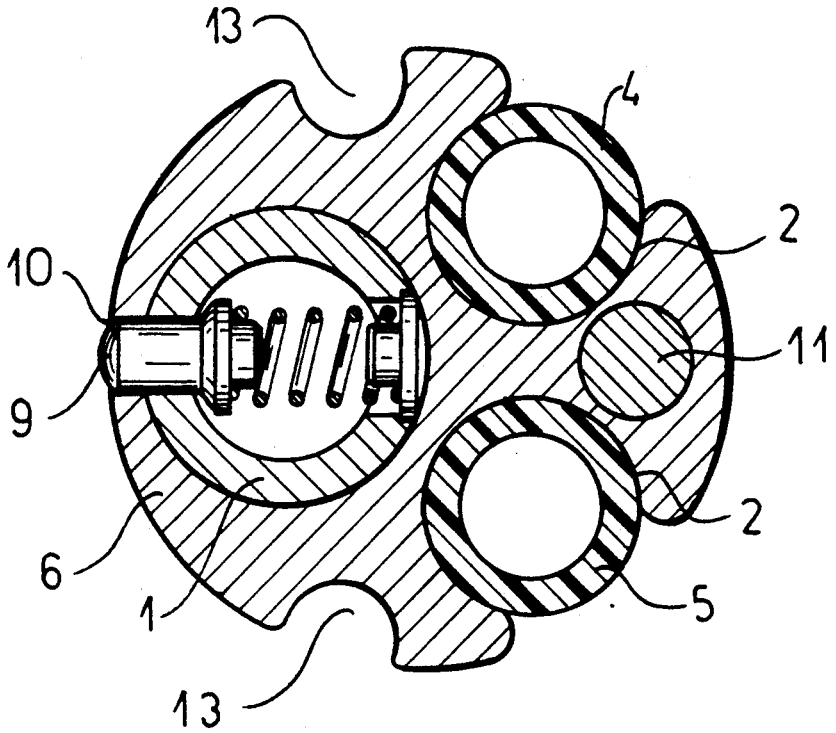
FIG. 2: A cross-sectional plan view of a second embodiment of the present invention.
Figure 3:
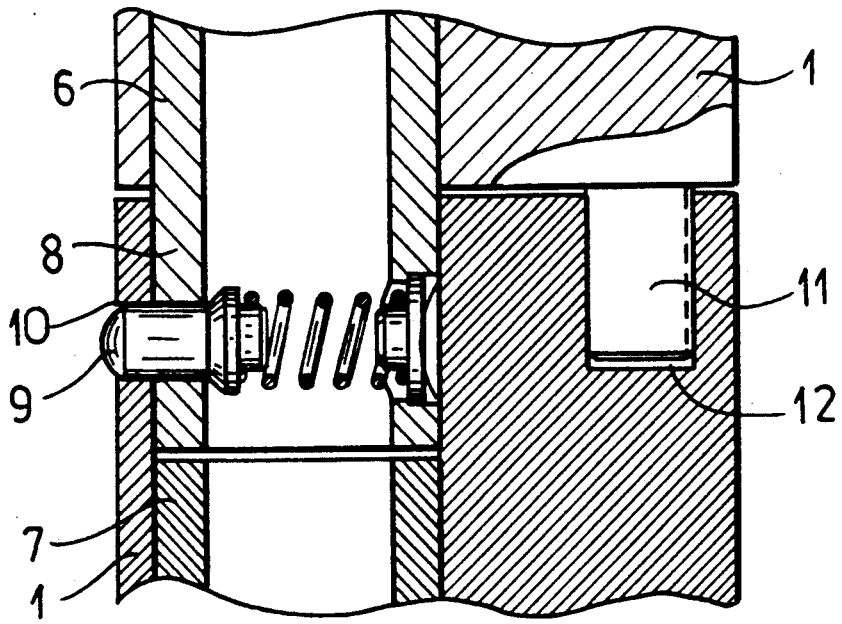
FIG. 3: A cross-sectional side view of the transitional area between two drilling rods as in the embodiment shown in FIG. 2.

In the embodiment shown in FIG. 2 and FIG. 3 the drilling rods 1 are solid. Since, in this embodiment, the flushing air for the in-hole hammer cannot be blown through the interior of the drilling rods 1, the drilling rods 1 incorporate compressed air hoses 6. The one end 7 of the compressed air hoses 6 is located within the drilling rods 2, whereas the other ends 8 extend out of this. In the freely projecting ends 8 there are spring-loaded locking pins 9 that pass through the compressed air hose 6 transversely to its longitudinal axis and in their locked position (as shown in FIG. 3) fit into the drillings 10 in the walls of the adjacent drilling rod 1. These spring-loaded locking pins 9 permit the rapid and simple changeover of drilling rods 1 when the rods are advanced or withdrawn.

As can be seen in FIG. 3, the drilling rods 1 have shaped pieces at their ends, and these ensure that the drilling rods can be joined to each other and cannot rotate independently of each other, and also ensure an aligned connection of the longitudinal channels 2 in the drilling rods. These shaped pieces consist of studs 11 that project from one end of the drilling rods 1, and recesses 12 at the other end of the drilling rod. The shapes of the projecting studs 11 and the recesses 12 that are associated with them are so matched that they fit positively one inside the other.

As can be seen from FIG. 2, on the outside of the drilling rods 1 there can be profiling 13 that extends in their longitudinal direction, and this profiling serves to transfer torque onto the drilling rod.

Figure 4:
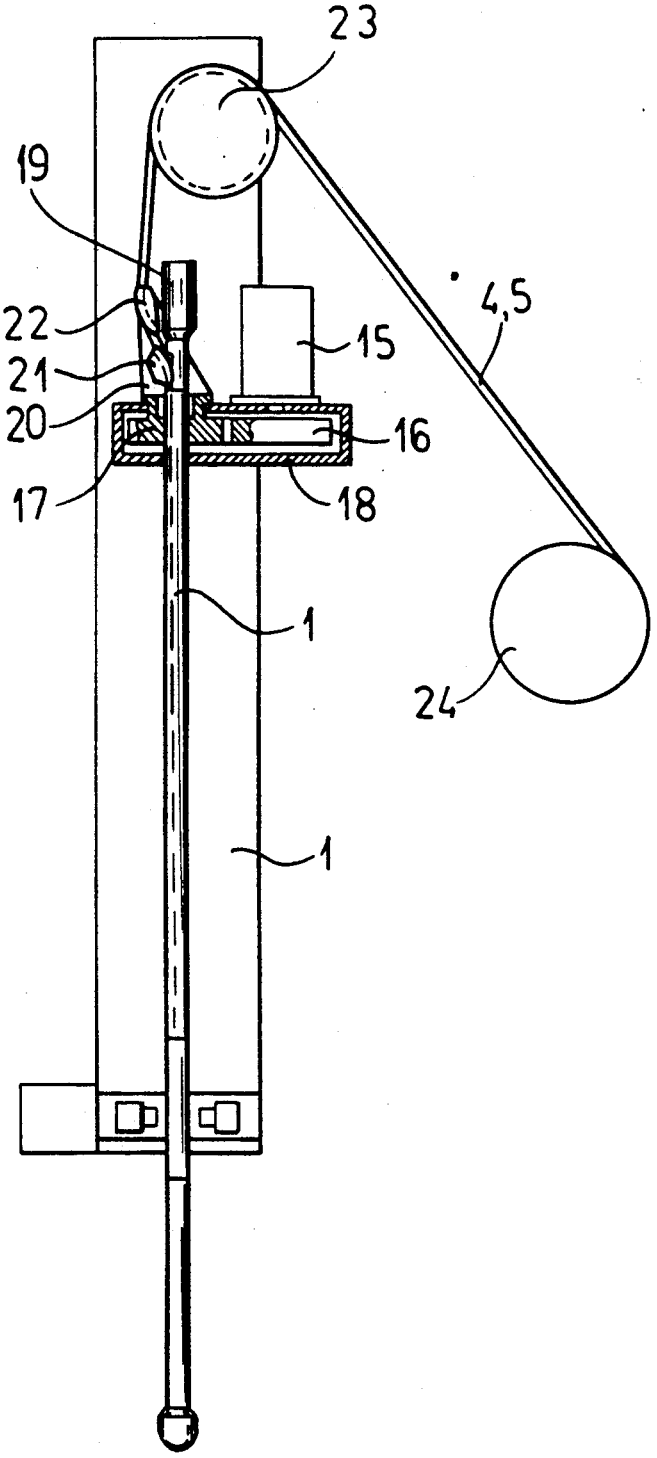
Figure 5:
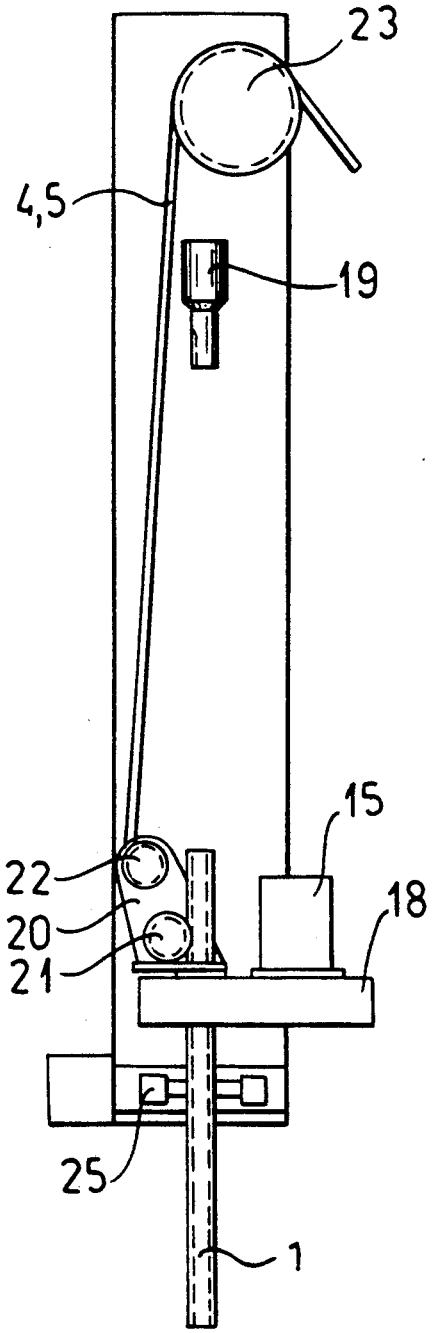
FIG. 5: A view as in FIG. 4, but with the drive for the drilling rods in the lower position.

In FIGS. 4 and 5, the carriage for the drilling apparatus is numbered 14; this is configured in the usual way.

The hydraulic drive system for the back and forth oscillatory movements of the drilling rod that is made up of individual bore rods 1 is numbered 15. As an example, an oscillating motor that is fitted with a gear system 16 that incorporates a drive pinion 17 that transfers the back and forth oscillating movement to the drilling rod can be used as the drive system 15. The drive system 15 with its gear system 16 for the drilling rod is located on a slide 18 that can be moved on the carriage 14. The slide 18 and the carriage 14, and the flushing head 19, are moved either are the flushing head 19 advances or by means of separate drive systems.

The hose threading and removal system 20 is mounted on the slide 18. This hose insertion system 20 is connected with the drive pinion 17 of the gear system 16 of the drive system 15 for the drilling rod, so that it can follow the back and forth oscillatory movement of the drilling rod.

The hose threading and removal system 20 has an insertion system 21 and a removal system 22 for each hydraulic hose 4, 5.

In the upper position of the slide 18, as is shown in FIG. 4, the insertion and the removal elements 22 as shown as sliding guides, and in the lower position of the slide 18, as is shown in FIG. 5, they are shown as guide rollers.

The insertion elements 21 and the removal elements 22 are so spaced apart that the associated hydraulic hoses 4, 5 pass around the removal element 22 that is remote from the drilling rods and can pass between the removal element 22 and the insertion element 21. In addition, the configuration of the hose threading and removal system 20 is such that the insertion and the removal elements 21, 22 are located in the upper stop position of the slide 8 with the drive system 15 in the area of the flushing head, with the removal elements 22 projecting beyond this.

The hydraulic hoses 4, 5 pass over guide rollers 23 to a pre-tensioned drum 24.

The hose threading and removal system 20 shown in FIGS. 4 and 5 operates as follows:

When the slide 18 with the drive system 15 and the flushing head 19 are in the position shown in FIG. 4, drilling with a drilling rod 1 that has been newly inserted from a drilling-rod magazine (not shown in greater detail herein) can be carried out. The drilling is advanced, for example, by a chain advance system for the flushing head 19. As soon as the slide 18 has reached its lower position, as indicated in FIG. 5, and the flushing head 19 has been returned to its upper, starting position, a new drilling rod 1 can be inserted from a drilling-rod magazine. The drilling rod that is already in the hole is held in the usual manner by the retaining head 25, whereupon the carriage 18 can be returned by the drive system to its upper position, as shown in FIG. 4. During this process, the hydraulic hoses 4, 5 are pressed into the longitudinal channels 2 in the newly inserted drilling rod 1 by means of the insertion elements 21. The newly inserted drilling rod 1 can then be drilled in, as is shown in FIG. 4.

When the drilling rod is withdrawn, the reverse order is followed when, in each instance, the hoses can be pressed out of the drilling rod that is to be removed by the removal elements 22 when the slide 1 is moved.

We claim:

1. A drilling apparatus comprising:

a carriage;

at least one drilling rod having front and rear ends;

a pressure-operated drive system for transmitting a back and forth drive movement to said drilling rod, said pressure-operated drive system being movable on said carriage;

a flushing head arranged on said carriage communicating with said rear end of said drilling rod detachable from or displaceable with said drilling rod; and a hydraulically operated in-hole hammer arranged on said front end of said drilling rod.

2. A drilling apparatus according to claim 1 wherein said drilling rod is rotated at an angle ranging between 180° to 360°.

3. A drilling apparatus according to claim 1 wherein said drive system includes an oscillating motor with a gear system.

4. A drilling apparatus according to claim 1 wherein said drilling rod is provided with a means for interlocking with said drive system to achieve transmission of torque therefrom, said means for interlocking being selected from the group consisting of profiling grooves along said drilling rods, a clamping device to secure a force fit between drilling rod and drive system and combinations thereof.

5. A drilling apparatus according to claim 1 further comprising a slide movable on said carriage and supporting said pressure-operated drive system.

6. A drilling apparatus according to claim 5 wherein movement of said slide and movement of said flushing head are each affected by a separate drive system.

7. A drilling apparatus according to claim 1 wherein said drilling rod is formed with two longitudinal channels partially open along an outer circumference of said rod, said channels each accommodating a hose, one of said hoses being utilized for feed and another for return of hydraulic oil for said in-hole hammer.

8. A drilling apparatus according to claim 7 wherein said open circumference of said longitudinal channels has a smaller arc than a circumference of said longitudinal channels adjacent an inner area of said drilling rod.

9. A drilling apparatus according to claim 1 wherein said drilling rod is formed with a longitudinal channel having a circumferential cross section a portion of which is open to an outside of said drilling rod, said longitudinal channel accommodating an air hose.

10. A drilling apparatus according to claim 9 wherein said flushing head in at least a lower area thereof includes longitudinal channels to accommodate a hose selected from the group consisting of a hydraulic hose, an air hose and combinations thereof.

11. A drilling apparatus according to claim 7 wherein said drilling rod has at said ends matching shaped elements that connect said drilling rod to another of said drilling rod in such manner that they cannot rotate independently of one another and so as to provide an aligned connection to said longitudinal channels within said drilling rods.

12. A drilling apparatus according to claim 11 wherein said shaped elements comprise studs arranged so as to project at one end of said drilling rod and at said other end recesses, said rod and recesses being matched with each other.

13. A drilling apparatus according to claim 11 wherein said connected drilling rods are joined to one another by means of a spring-loaded locking pin.

14. A drilling apparatus according to claim 13 wherein said drilling rod is fitted with a flushing-air line, one end of which being located within the said drilling rod and the other end projecting freely from said rod and extending into an unattached end of an adjacent drilling rod, said spring-loaded locking pin being located within said flushing-air line, said locking pin passing transversely through said flushing-air line and fitting into a drilling in a wall of said drilling rod when in a rest position.

15. A drilling apparatus according to claim 1 further comprising a hose threading and removal system on said carriage in front of an area where said drilling rod is connected to an adjacent drilling rod.

16. A drilling apparatus according to claim 15 further comprising a slide supporting said drive system, said slide including a drive element for communicating said back and forth drive movement to said drilling rod, said hose threading and removal system being installed on said slide and being coupled either directly or indirectly with said drive element.

17. A drilling apparatus according to claim 15 further comprising a plurality of hoses accommodated within longitudinal channels of said drilling rod, said hose threading and removal system having an insertion and a removal element for each of said hoses.

18. A drilling apparatus according to claim 17 wherein said insertion and removal elements for each hose are so spaced that said respective hose can pass around said removal element that is remote from said drilling rod and between said removal element and said insertion element that is proximate to said drilling rod.

19. A drilling apparatus according to claim 18 wherein said insertion and removal elements can be folded out of an area of said drilling rod.

20. A drilling apparatus according to claim 18 further comprising a pre-tensioned drum around which said hoses may be secured.

* * * * *